US006812905B2

(12) United States Patent
Thomas et al.

(10) Patent No.: US 6,812,905 B2
(45) Date of Patent: Nov. 2, 2004

(54) INTEGRATED ACTIVE ANTENNA FOR MULTI-CARRIER APPLICATIONS

(75) Inventors: Mike Thomas, Richardson, TX (US); Mano D. Judd, Rockwall, TX (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 09/998,873

(22) Filed: Oct. 31, 2001

(65) Prior Publication Data

US 2002/0111192 A1 Aug. 15, 2002

Related U.S. Application Data

(63) Continuation-in-part of application No. 09/299,850, filed on Apr. 26, 1999.

(60) Provisional application No. 60/244,881, filed on Nov. 1, 2000.

(51) Int. Cl.[7] ..... H01Q 21/00

(52) U.S. Cl. ..... 343/853; 343/876; 343/890; 342/359; 455/572

(58) Field of Search ..... 343/700 MS, 793, 343/795, 853, 876, 878, 890, 893; 342/372, 359; 455/278, 277.1, 572

(56) References Cited

U.S. PATENT DOCUMENTS

| | | | | |
|---|---|---|---|---|
| 4,070,637 A | * | 1/1978 | Assal et al. | 333/7 R |
| 4,124,852 A | | 11/1978 | Steudel | 343/854 |
| 4,246,585 A | | 1/1981 | Mailloux | 343/854 |
| 4,360,813 A | | 11/1982 | Fitzsimmons | 343/100 |
| 4,566,013 A | | 1/1986 | Steinberg et al. | 343/372 |
| 4,607,389 A | | 8/1986 | Halgrimson | 455/11 |
| 4,614,947 A | | 9/1986 | Rammos | 343/778 |
| 4,689,631 A | | 8/1987 | Gans et al. | 343/781 |
| 4,825,172 A | | 4/1989 | Thompson | 330/124 |
| 4,849,763 A | | 7/1989 | DuFort | 342/372 |
| 4,890,110 A | | 12/1989 | Kuwahara | 342/35 |
| 4,994,813 A | | 2/1991 | Shiramatsu et al. | 342/360 |
| 5,034,752 A | | 7/1991 | Pourailly et al. | 342/373 |
| 5,038,150 A | | 8/1991 | Bains | 342/373 |
| 5,061,939 A | | 10/1991 | Nakase | 343/700 |

(List continued on next page.)

FOREIGN PATENT DOCUMENTS

| | | | |
|---|---|---|---|
| CA | 2306650 | 10/2000 | H01Q/21/06 |
| EP | 0 245 955 A2 | 11/1987 | H03F/1/32 |
| EP | 0 447 218 B1 | 9/1991 | H01Q/5/00 |
| EP | 0 713 261 B1 | 5/1996 | H01Q/3/26 |
| EP | 0 984 554 A2 | 3/2000 | H03F/1/32 |

(List continued on next page.)

OTHER PUBLICATIONS

Howat, F., "Cell Like Performace Using the Remotely Controlled Cellular Transmitter", *Gateway to New Concepts in Vehicular Technology*, San Francisco, CA, May 1–3, 1989, Vehicular Technology Conference, 39th IEEE, vol. 2, pp. 535–541, XP000076080.

(List continued on next page.)

*Primary Examiner*—Tho Phan
(74) *Attorney, Agent, or Firm*—Wood, Herron & Evans, LLP

(57) ABSTRACT

A distributed antenna array comprising a plurality of antenna elements, and a plurality of power amplifiers, each power amplifier being operatively coupled with one of said antenna elements and mounted closely adjacent to the associated antenna element, such that no appreciable power loss occurs between the power amplifier and the associated antenna element, each said power amplifier comprising a relatively low power, linear power amplifier.

21 Claims, 9 Drawing Sheets

U.S. PATENT DOCUMENTS

| | | | | | |
|---|---|---|---|---|---|
| 5,230,080 | A | | 7/1993 | Fabre et al. | 455/15 |
| 5,247,310 | A | | 9/1993 | Waters | 342/368 |
| 5,248,980 | A | | 9/1993 | Raguenet | 342/354 |
| 5,270,721 | A | | 12/1993 | Tsukamoto et al. | 343/700 |
| 5,280,297 | A | | 1/1994 | Profera, Jr. | 343/754 |
| 5,327,150 | A | | 7/1994 | Cherrette | 343/771 |
| 5,355,143 | A | | 10/1994 | Zurcher et al. | 343/700 |
| RE34,796 | E | * | 11/1994 | Smith et al. | 343/876 |
| 5,379,455 | A | | 1/1995 | Koschek | 455/273 |
| 5,412,414 | A | | 5/1995 | Ast et al. | 342/174 |
| 5,457,557 | A | | 10/1995 | Zarem et al. | 359/121 |
| 5,513,176 | A | | 4/1996 | Dean et al. | 370/18 |
| 5,548,813 | A | * | 8/1996 | Charas et al. | 455/562.1 |
| 5,554,865 | A | | 9/1996 | Larson | 257/275 |
| 5,568,160 | A | | 10/1996 | Collins | 343/778 |
| 5,596,329 | A | | 1/1997 | Searle et al. | 342/374 |
| 5,604,462 | A | | 2/1997 | Gans et al. | 330/124 |
| 5,604,925 | A | * | 2/1997 | O'Malley et al. | 455/254 |
| 5,610,510 | A | | 3/1997 | Boone et al. | 324/95 |
| 5,619,210 | A | | 4/1997 | Dent | 342/352 |
| 5,623,269 | A | | 4/1997 | Hirshfield et al. | 342/354 |
| 5,644,316 | A | | 7/1997 | Lewis et al. | 342/174 |
| 5,644,622 | A | | 7/1997 | Russell et al. | 455/422 |
| 5,646,631 | A | | 7/1997 | Arntz | 342/373 |
| 5,657,374 | A | | 8/1997 | Russell et al. | 370/328 |
| 5,659,322 | A | | 8/1997 | Caille | 342/188 |
| 5,710,804 | A | | 1/1998 | Bhame et al. | 379/58 |
| 5,714,957 | A | | 2/1998 | Searle et al. | 342/374 |
| 5,724,666 | A | | 3/1998 | Dent | 455/562 |
| 5,751,250 | A | | 5/1998 | Arntz | 342/373 |
| 5,754,139 | A | | 5/1998 | Turcotte et al. | 342/373 |
| 5,758,287 | A | | 5/1998 | Lee et al. | 455/450 |
| 5,770,970 | A | | 6/1998 | Ikeda et al. | 330/286 |
| 5,771,017 | A | | 6/1998 | Dean et al. | 342/374 |
| 5,790,078 | A | * | 8/1998 | Suzuki et al. | 343/700 MS |
| 5,802,173 | A | | 9/1998 | Hamilton-Piercy et al. | 379/56.2 |
| 5,809,395 | A | | 9/1998 | Hamilton-Piercy et al. | 455/4.1 |
| 5,815,115 | A | * | 9/1998 | Carloni et al. | 342/359 |
| 5,825,762 | A | | 10/1998 | Kamin, Jr. et al. | 370/335 |
| 5,832,389 | A | | 11/1998 | Dent | 455/562 |
| 5,835,128 | A | * | 11/1998 | Macdonald et al. | 348/8 |
| 5,854,611 | A | | 12/1998 | Gans et al. | 342/373 |
| 5,856,804 | A | | 1/1999 | Turcotte et al. | 342/371 |
| 5,862,459 | A | | 1/1999 | Charas | 455/114 |
| 5,878,345 | A | | 3/1999 | Ray et al. | 455/431 |
| 5,896,104 | A | | 4/1999 | Komatsu et al. | 342/175 |
| 5,936,577 | A | | 8/1999 | Shoki et al. | 342/373 |
| 5,936,591 | A | * | 8/1999 | Yamasa et al. | 343/853 |
| 5,940,045 | A | * | 8/1999 | Belcher et al. | 343/850 |
| 5,949,376 | A | | 9/1999 | McDonald et al. | 343/700 MS |
| 5,966,094 | A | | 10/1999 | Ward et al. | 342/373 |
| 5,987,335 | A | | 11/1999 | Knoedl, Jr. et al. | 455/561 |
| 6,008,763 | A | | 12/1999 | Nystrom et al. | 343/700 |
| 6,016,123 | A | | 1/2000 | Barton et al. | 342/373 |
| 6,018,643 | A | | 1/2000 | Golemon et al. | 455/63 |
| 6,037,903 | A | | 3/2000 | Lange et al. | 343/700 |
| 6,043,790 | A | | 3/2000 | Derneryd et al. | 343/853 |
| 6,047,199 | A | | 4/2000 | DeMarco | 455/572 |
| 6,072,434 | A | | 6/2000 | Papatheodorou | 343/700 |
| 6,091,360 | A | | 7/2000 | Reits | 342/368 |
| 6,094,165 | A | | 7/2000 | Smith | 342/373 |
| 6,104,935 | A | | 8/2000 | Smith et al. | 455/562 |
| 6,140,976 | A | | 10/2000 | Locke et al. | 343/853 |
| 6,144,652 | A | | 11/2000 | Avidor et al. | 370/336 |
| 6,157,343 | A | | 12/2000 | Andersson et al. | 342/371 |
| 6,160,514 | A | | 12/2000 | Judd | 343/700 |
| 6,222,503 | B1 | | 4/2001 | Gietema et al. | 343/890 |
| 6,233,434 | B1 | | 5/2001 | Takei | 455/103 |
| 6,233,466 | B1 | | 5/2001 | Wong et al. | 455/562 |
| 6,266,545 | B1 | * | 7/2001 | Backman et al. | 455/572 |
| 6,519,478 | B1 | * | 2/2003 | Scherzer et al. | 455/562 |

FOREIGN PATENT DOCUMENTS

| | | | | |
|---|---|---|---|---|
| GB | 2286749 | A | 8/1995 | H04B/7/08 |
| GB | 2 320 618 | A | 6/1998 | H04Q/7/36 |
| WO | WO 95/26116 | | 9/1995 | H04Q/7/36 |
| WO | WO 95/34102 | | 12/1995 | H01Q/1/38 |
| WO | WO 98/09372 | | 3/1998 | H03F/1/32 |
| WO | WO 98/11626 | | 3/1998 | H01Q/23/00 |
| WO | WO 98/39851 | | 9/1998 | H04B/1/38 |
| WO | WO 98/50981 | | 11/1998 | H01Q/3/40 |
| WO | WO 99/26317 | | 5/1999 | H01Q/21/30 |
| WO | WO 00/03479 | | 1/2000 | H03F/3/21 |
| WO | WO 00/31824 | | 6/2000 | H01Q/5/00 |
| WO | WO 00/39943 | | 7/2000 | H04B/7/04 |
| WO | WO 01/06801 | A1 | 1/2001 | H04Q/7/30 |
| WO | WO 02/19470 | A1 | 3/2002 | H01Q/23/00 |
| WO | WO 02/039541 | A3 | 5/2002 | H01Q/1/24 |

OTHER PUBLICATIONS

Shibutani, Makoto et al., "Optical Fiber Feeder for Microcellular Mobile Communication Systems (H–015)", *IEEE Journal on Selected Areas in Communications*, IEEE Inc., New York, NY, vol. 11, No. 7, Sep. 1993, pp. 1118–1126, XP000400021, ISSN: 0733–8716.

International Search Report, European Patent Office, Feb. 10, 2003 (11 pages).

*Communication Relating to the Results of the Partial International Search*, Invitation to Pay Additional Fees, Annex Form PCT/ISA/206, Oct. 21, 2002 (7 pages).

PCT, *Written Opinion* (*PCT Rule 66*), European Patent Office, Feb. 26, 2003 (6 pages).

Cova et al., *High Linearity Multicarrier RF Amplifier*, US. patent application Publication No. 2002/O008577, Publication Date Jan. 24, 2002 (13 pages).

* cited by examiner

INTEGRATED ACTIVE ANTENNA FOR MULTI-CARRIER APPLICATIONS

CROSS-REFERENCE TO RELATED APPLICATION

This application claims the filing benefit of Provisional Application U.S. Ser. No. 60/244,881, filed Nov. 1, 2000, entitled "Integrated Active Antenna For Multi-Carrier Applications", and is a continuation-in-part of U.S. patent application, Ser. No. 09/299,850, filed Apr. 26, 1999, entitled "Antenna Structure and Installation", each disclosure of which is hereby incorporated herein by reference in its entirety.

FIELD OF THE INVENTION

This invention is directed generally to active antennas and more particularly to an integrated active antenna for multi-carrier applications.

BACKGROUND OF THE INVENTION

In communications equipment such as cellular and Personal Communications Service (PCS), as well as multi-channel multi-point distribution systems (MMDS) and local multi-point distribution systems (LMDS), it has been conventional to receive and retransmit signals from users or subscribers utilizing antennas mounted at the tops of towers or other structures. Other communications systems such as wireless local loop (WLL), specialized mobile radio (SMR), and wireless local area network (WLAN), have signal transmission infrastructure for receiving and transmitting communications between system users or subscribers which may also utilize various forms of antennas and transceivers.

All of these communications systems require amplification of the signals being transmitted by the antennas. For this purpose, it has heretofore been the practice to use a conventional linear power amplifier system placed at the bottom of the tower or other structure, with relatively long coaxial cables connecting with antenna elements mounted on the tower. The power losses experienced in the cables may necessitate some increases in the power amplification which is typically provided at the ground level infrastructure or base station, thus further increasing the expense per unit or cost per watt.

Output power levels for infrastructure (base station) applications in many of the foregoing communications systems are typically in excess of ten watts, and often up to hundreds of watts, which results in a relatively high effective isotropic power requirement (EIRP). For example, for a typical base station with a twenty-watt power output (at ground level), the power delivered to the antenna, minus cable losses, is around ten wafts. In this case, half of the power has been consumed in cable loss/heat. Such systems require complex linear amplifier components cascaded into high power circuits to achieve the required linearity at the higher output power. Typically, for such high power systems or amplifiers, additional high power combiners must be used.

All of this additional circuitry to achieve linearity of the overall system, which is required for relatively high output systems, results in a relatively high cost per unit/watt.

The present invention proposes placing linear amplifiers in the tower close to the antenna(s) and also, distributing the power across multiple antenna (array) elements, to achieve a lower power level per antenna element and utilize power amplifier technology at a much lower cost level (per unit/per watt).

In accordance with one aspect of the invention, linear (multi-carrier) power amplifiers of relatively low power are utilized. In order to utilize such relatively low power amplifiers, the present invention proposes use of an antenna array in which one relatively low power linear amplifier is utilized in connection with each antenna element of the array to achieve the desired overall output power of the array.

Moreover, the invention proposes installing a linear power amplifier of this type at or near the feed point of each element of a multi-element antenna array. Thus, the output power of the antenna system as a whole may be multiplied by the number of elements utilized in the array while maintaining linearity.

Furthermore, the present invention does not require relatively expensive high power combiners, since the signals are combined in free space (at the far field) at the remote or terminal location via electromagnetic waves. Thus, the proposed system uses low power combining, avoiding otherwise conventional combining costs. Also, in tower applications, the system of the invention eliminates the power loss problems associated with the relatively long cable which conventionally connects the amplifiers in the base station equipment with the tower-mounted antenna equipment, i.e., by eliminating the usual concerns with power loss in the cable and contributing to a lesser power requirement at the antenna elements. Thus, by placing the amplifiers close to the antenna elements, amplification is accomplished after cable or other transmission line losses usually experienced in such systems. This may further decrease the need for low loss cables, thus further reducing overall system costs.

The use of multi-carrier linear power amplifiers at or near the feed point of each element in the multi-element antenna array improves transmit efficiency, receive sensitivity and reliability for multi-carrier communications systems.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 1:
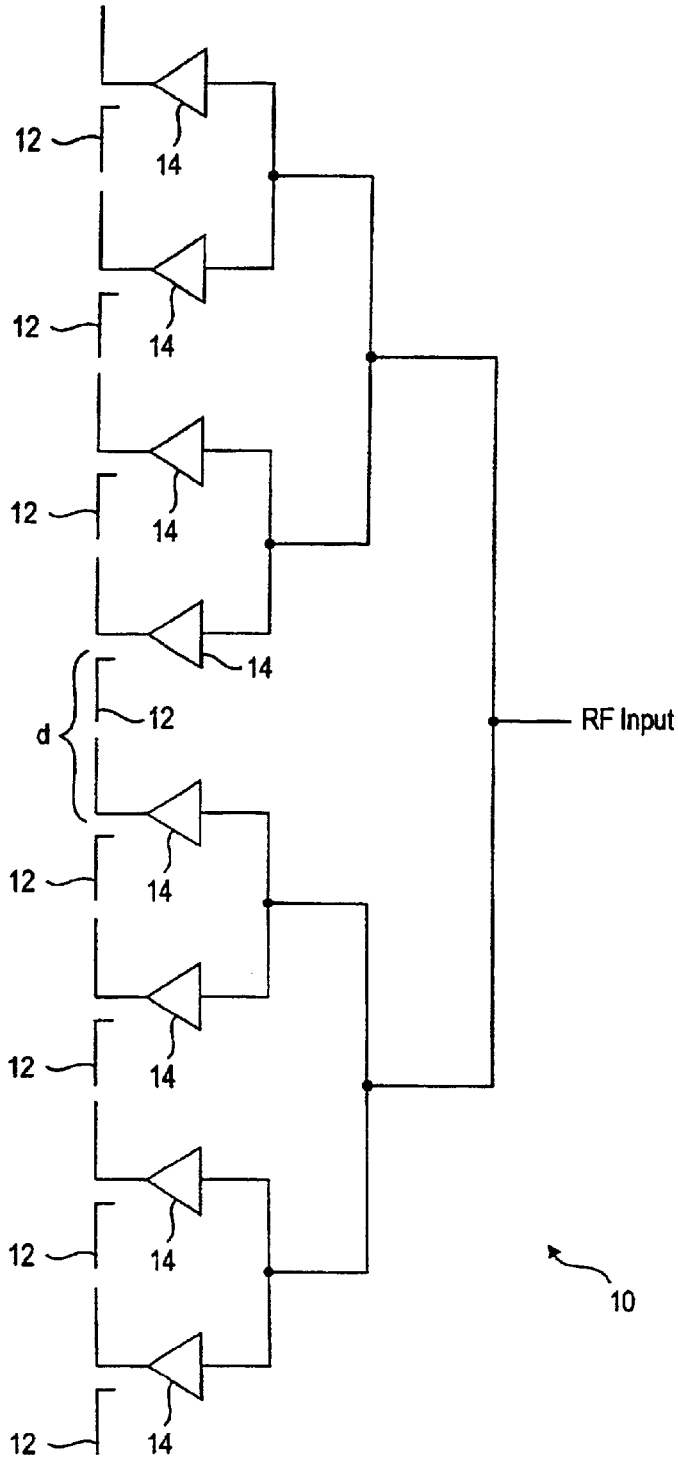
FIG. 1 is a simplified schematic of an antenna array utilizing linear power amplifier modules in accordance with one form of the invention.
Figure 2:
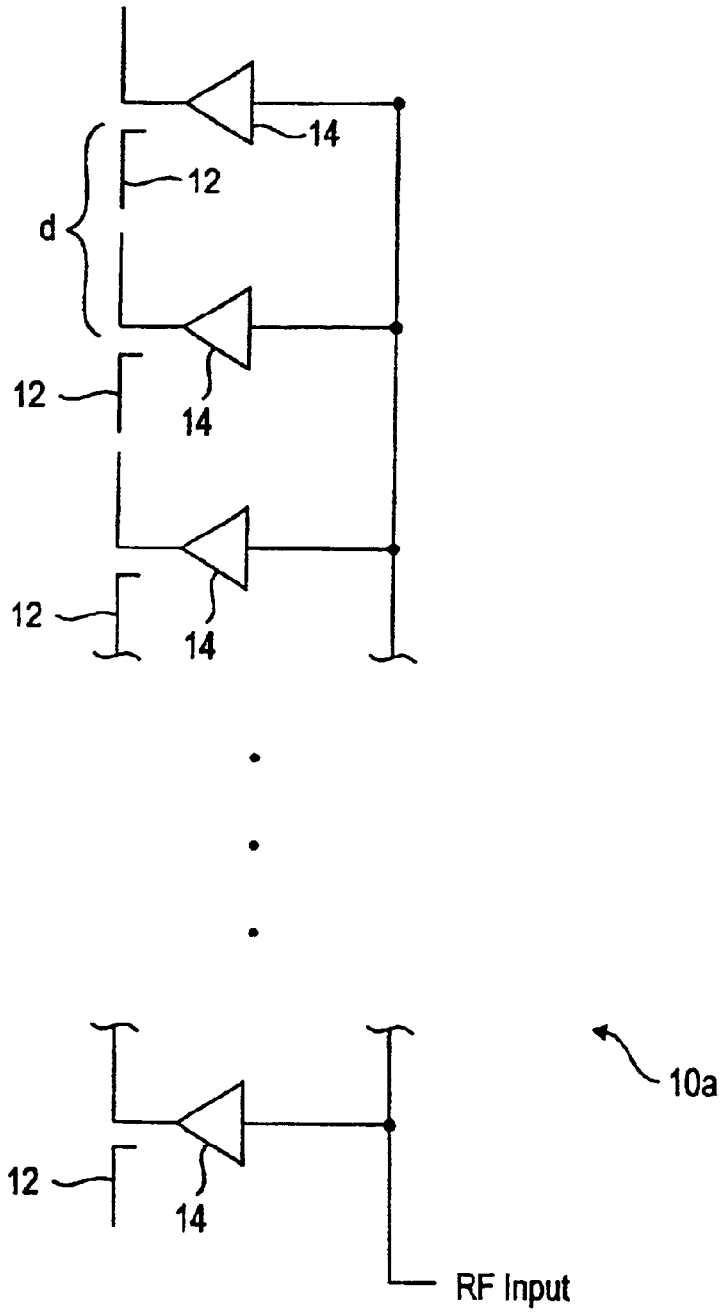
FIG. 2 is a schematic similar to FIG. 1 in showing an alternate embodiment.

Referring now to the drawings, and initially to FIGS. 1 and 2, there are shown two examples of a multiple antenna element antenna array 10, 10*a* in accordance with the invention. The antenna array 10, 10*a* of FIGS. 1 and 2 differ in the configuration of the feed structure utilized, FIG. 1 illustrating a parallel corporate feed structure and FIG. 2 illustrating a series corporate feed structure. In other respects, the two antenna arrays 10, 10*a* are substantially identical. Each of the arrays 10, 10*a* includes a plurality of antenna elements 12, which may comprise monopole, dipole or microstrip/patch antenna elements. Other types of antenna elements may be utilized to form the arrays 10, 10*a* without departing from the invention.

In accordance with one aspect of the invention, a multi-carrier, linear amplifier 14 is operatively coupled to the feed of each antenna element 12 and is mounted in close proximity to the associated antenna element 12. In one embodiment, the amplifiers 14 are mounted sufficiently close to each antenna element so that no appreciable losses will occur between the amplifier output and the input of the antenna element, as might be the case if the amplifiers were coupled to the antenna elements by a length of cable or the like. For example, the power amplifiers 14 may be located at or near the feed point of each antenna element.

In the antenna arrays of FIGS. 1 and 2, array phasing may be adjusted by varying the line length in the corporate feed or by electronic circuitry within the power amplifiers 14. The array amplitude coefficient adjustment may be accomplished through the use of attenuators before or within the power amplifiers 14, as shown in FIG. 3.

Figure 3:
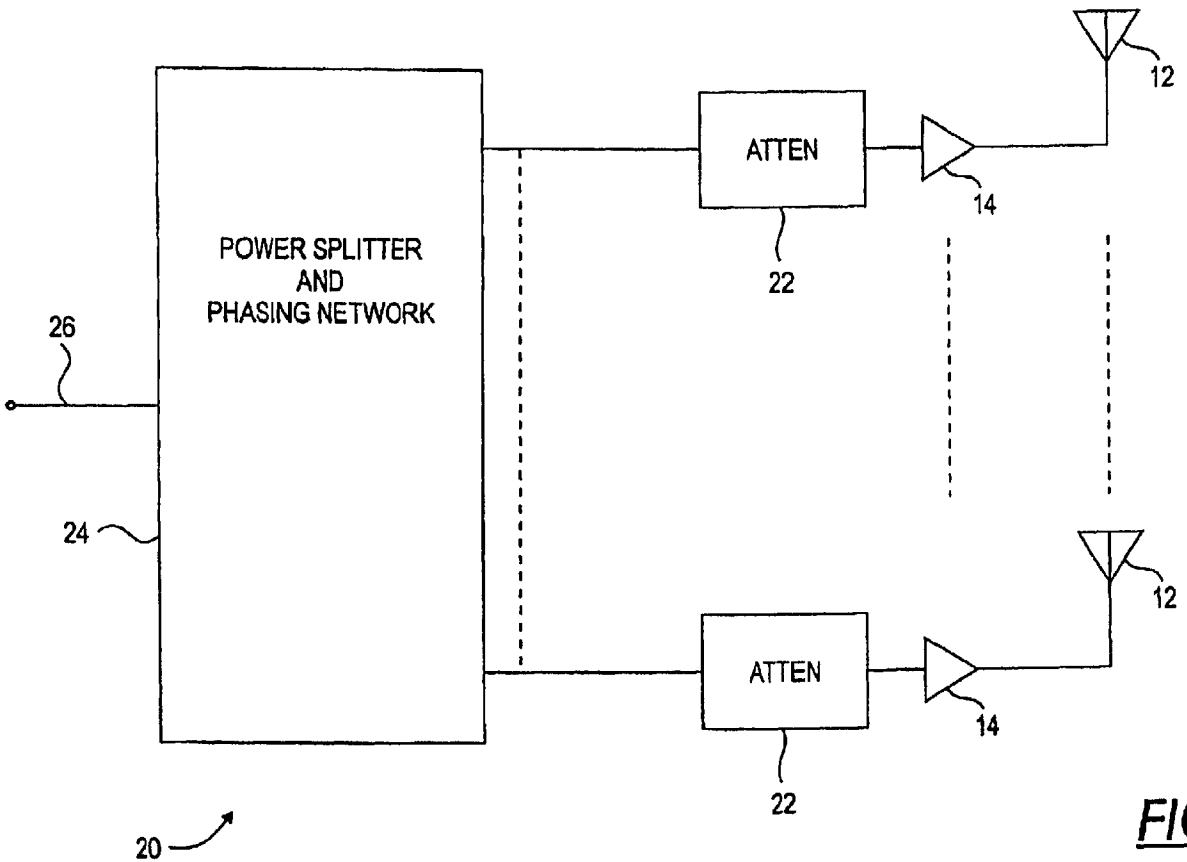
FIG. 3 is a block diagram of an antenna assembly or system in accordance with one aspect of the invention.

Referring now to FIG. 3, an antenna system in accordance with the invention and utilizing an antenna array of the type shown in either FIG. 1 or FIG. 2 is designated generally by the reference numeral 20. The antenna system 20 includes a plurality of antenna elements 12 and associated multi-carrier linear power amplifiers 14 as described above in connection with FIGS. 1 and 2. Also operatively coupled in series circuit with the power amplifiers 14 are suitable attenuator circuits 22. The attenuator circuits 22 may be interposed either before or within the power amplifier 14; however, FIG. 3 illustrates them at the input to each power amplifier 14. A power splitter and phasing network 24 feeds all of the power amplifiers 14 and their associated series connected attenuator circuits 22. An RF input 26 feeds into this power splitter and phasing network 24.

Figure 4:
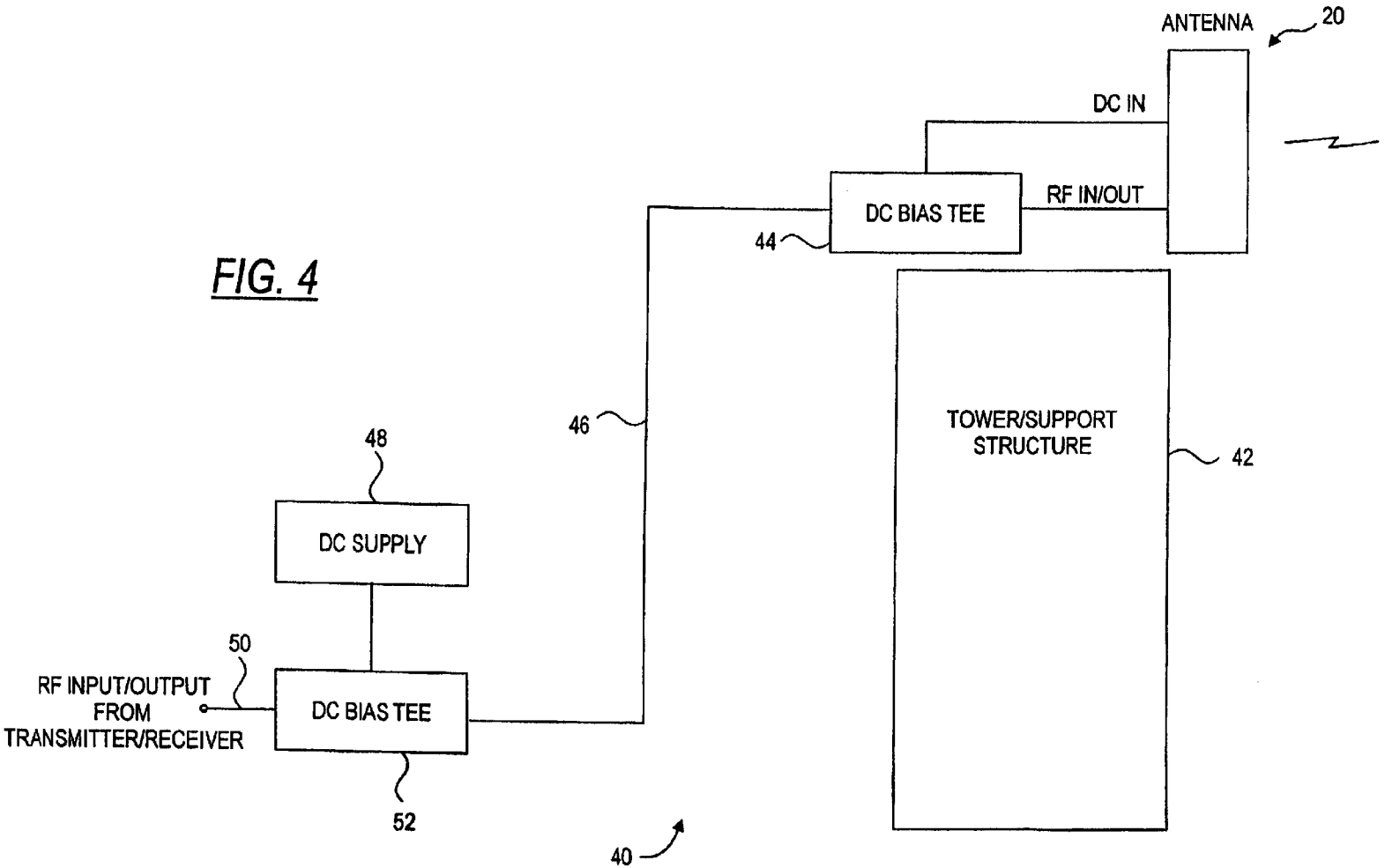
FIG. 4 is a block diagram of a communications system base station utilizing a tower or other support structure, and employing an antenna system in accordance with one aspect of the invention.

Referring to FIG. 4, an antenna system installation utilizing the antenna system 20 of FIG. 3 is designated generally by the reference numeral 40. FIG. 4 illustrates a base station or infrastructure configuration for a communications system such as a cellular system, a personal communications system PCS or a multi-channel multipoint distribution system (MMDS). The antenna structure or assembly 20 of FIG. 3 is mounted at the top of a tower or other support structure 42. A DC bias tee 44 separates signals received via a coaxial cable 46 into DC power and RF components, and conversely receives incoming RF signals from the antenna system 20 and delivers the same to the coaxial line or cable 46 which couples the tower-mounted components to ground based components. The ground-based components may include a DC power supply 48 and an RF input/output 50 from a transmitter/receiver (not shown), which may be located at a remote equipment location, and hence is not shown in FIG. 4. A similar DC bias 52 receives the DC supply and RF input and couples them to the coaxial line 46, and conversely delivers signals from the antenna structure 20 to the RF input/output 50.

Figure 5:
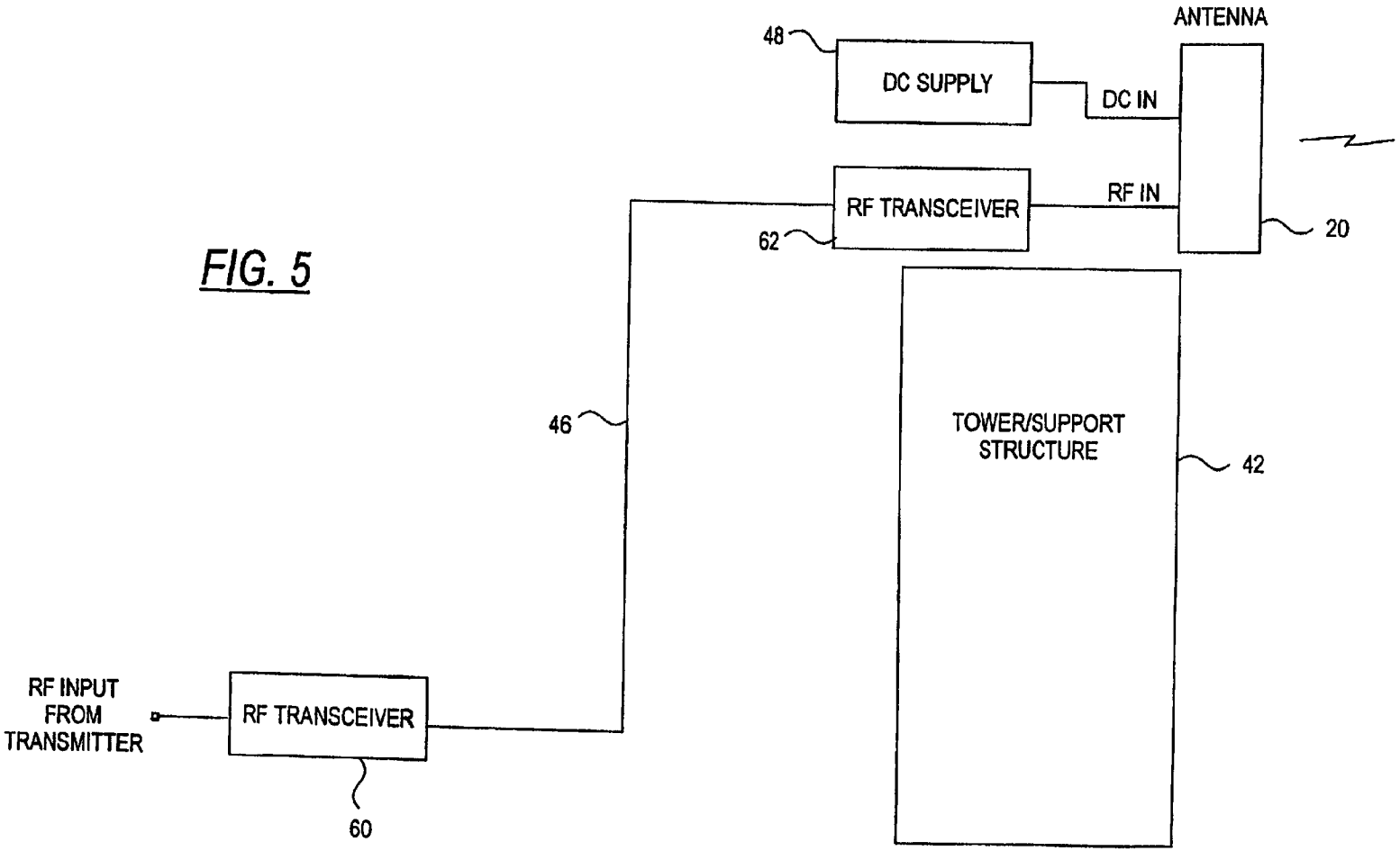
FIG. 5 is a block diagram of a communications system base station employing the antenna system in accordance with another aspect of the invention.

FIG. 5 illustrates a communications system base station employing the antenna structure or system 20 as described above. In similar fashion to the installation of FIG. 4, the installation of FIG. 5 mounts the antenna system 20 atop a tower/support structure 42. Also, a coaxial cable 46, for example, an RF coaxial cable for carrying RF transmissions, runs between the top of the tower/support structure and ground based equipment. The ground based equipment may include an RF transceiver 60 which has an RF input from a transmitter. Another similar RF transceiver 62 is located at the top of the tower and exchanges RF signals with an antenna structure or system 20. A power supply such as a DC supply 48 is also provided for the antenna system 20, and is located at the top of the tower 42 in the embodiment shown in FIG. 5.

Figure 8:
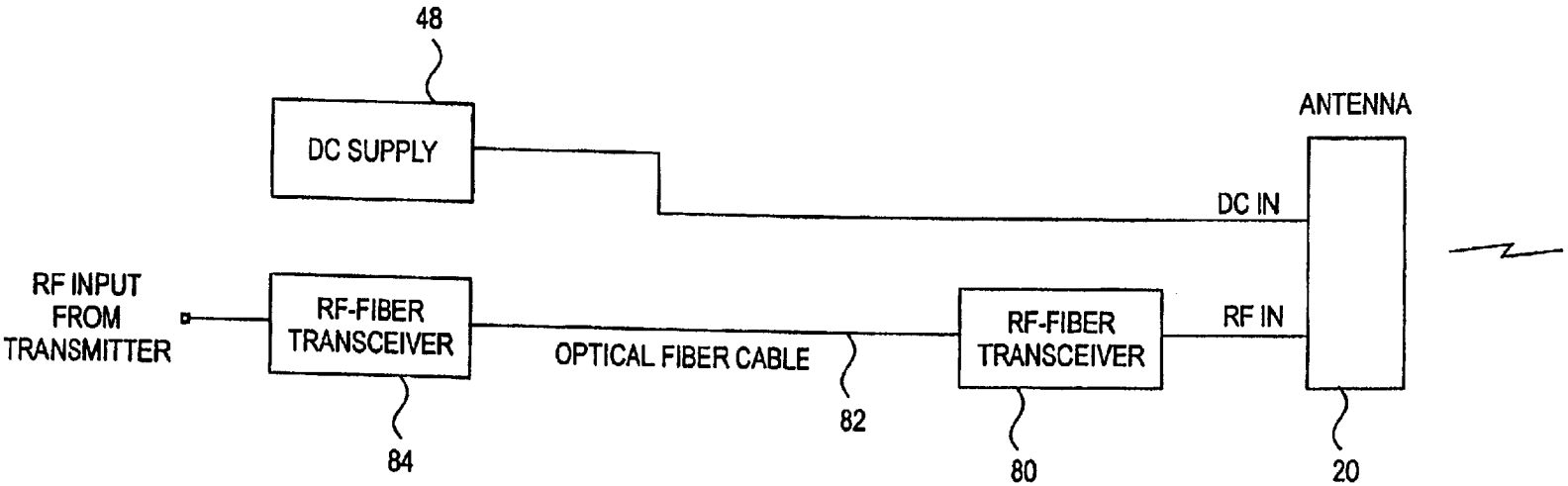

Alternatively, the two transceivers 60, 62 may be RF-to-fiber optic transceivers (as shown for example, in FIG. 8), and the cable 46 may be a fiber optic or "optical fiber" cable, e.g., as shown in FIG. 8.

Figure 6:
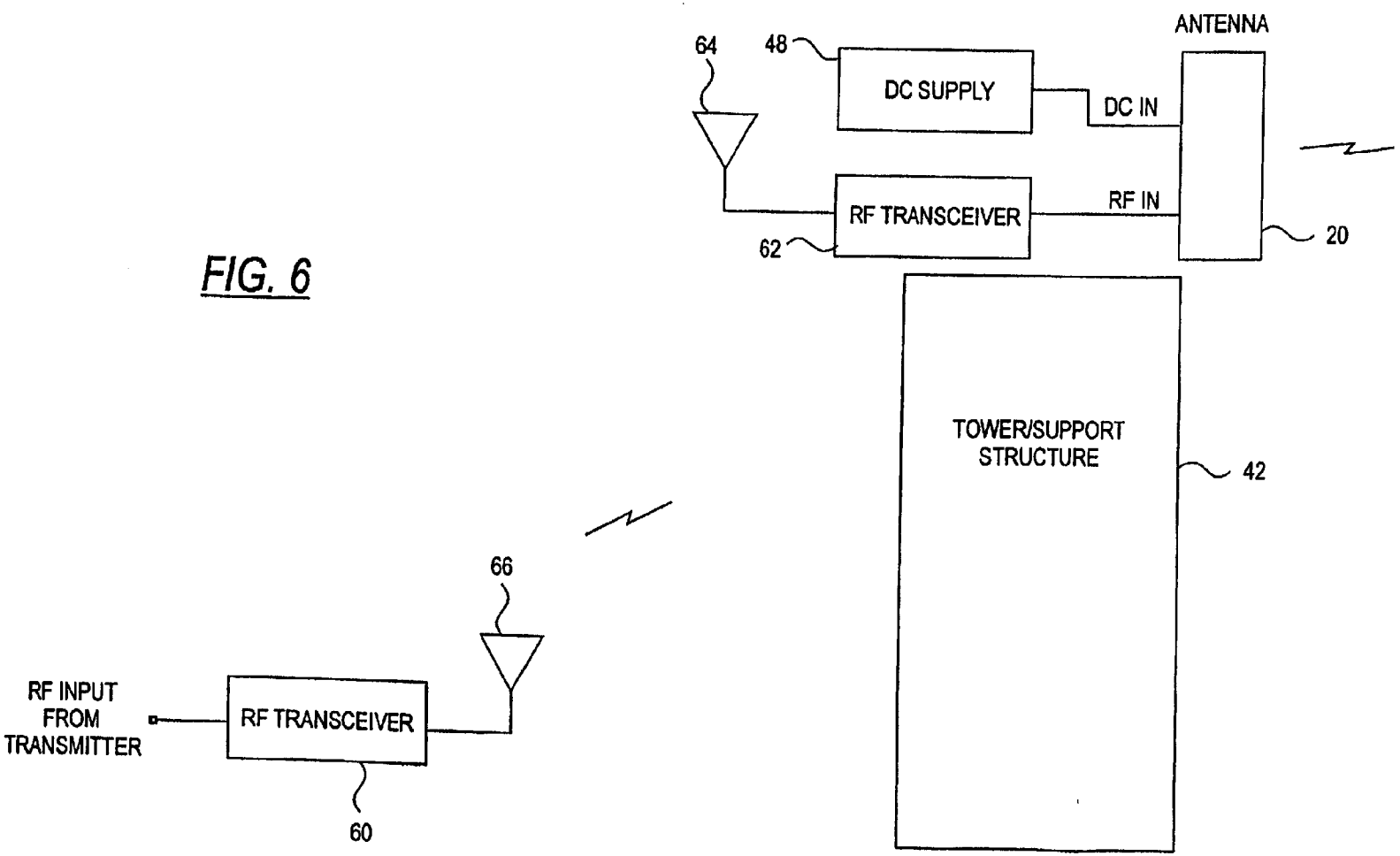
FIG. 6 is a block diagram of a communications system base station employing the antenna system in accordance with yet another aspect of the invention.

FIG. 6 illustrates a communications system base station which also mounts an antenna structure or system 20 of the type described above at the top of a tower/support structure 42. In similar fashion to the installation of FIG. 5, an RF transceiver and power supply such as a DC supply 48 are also located at the top of the tower/support and are operatively coupled with the antenna system 20. A second or remote RF transceiver 60 may be located adjacent the base of the tower or otherwise within a range of a wireless link which links the transceivers 60 and 62, by use of respective transceiver antenna elements 64 and 66 as illustrated in FIG. 6.

Figure 7:
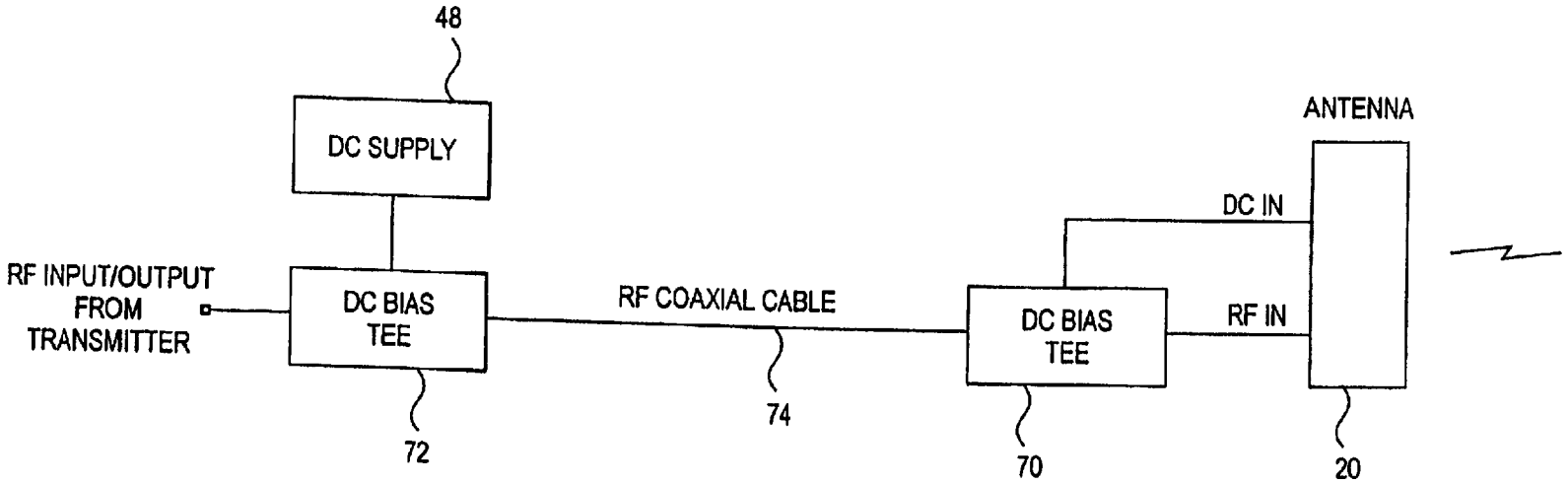
FIGS. 7 and 8 are block diagrams of two types of communications system base stations utilizing the antenna system in accordance with still yet another aspect of the invention.

FIGS. 7 and 8 illustrate examples of use of the antenna structure or system 20 of the invention in connection with communications system base stations, such as in-building communication applications by way of example. In FIG. 7, respective DC bias tees 70 and 72 are linked by an RF coaxial cable 74. The DC bias tee 70 is located adjacent the antenna system 20 and has respective RF and DC lines operatively coupled therewith. The second DC bias tee 72 is coupled to an RF input/output from a transmitter/receiver and to a suitable DC supply 48. The DC bias tees and DC supply operate in conjunction with the antenna system 20 and a remote transmitter/receiver (not shown) in much the same fashion as described hereinabove with reference to the system of FIG. 4.

In FIG. 8, the antenna system 20 receives an RF line from a fiber-RF transceiver 80, which is coupled through an optical fiber cable 82 to a second RF-fiber transceiver 84 which may be located remotely from the antenna and first transceiver 80. A DC supply or other power supply for the antenna may be located either remotely, as illustrated in FIG. 8 or adjacent the antenna system 20, if desired. The DC supply 48 is provided with a separate line operatively coupled to the antenna system 20, in much the same fashion as illustrated, for example, in the installation of FIG. 6.

Figure 9:
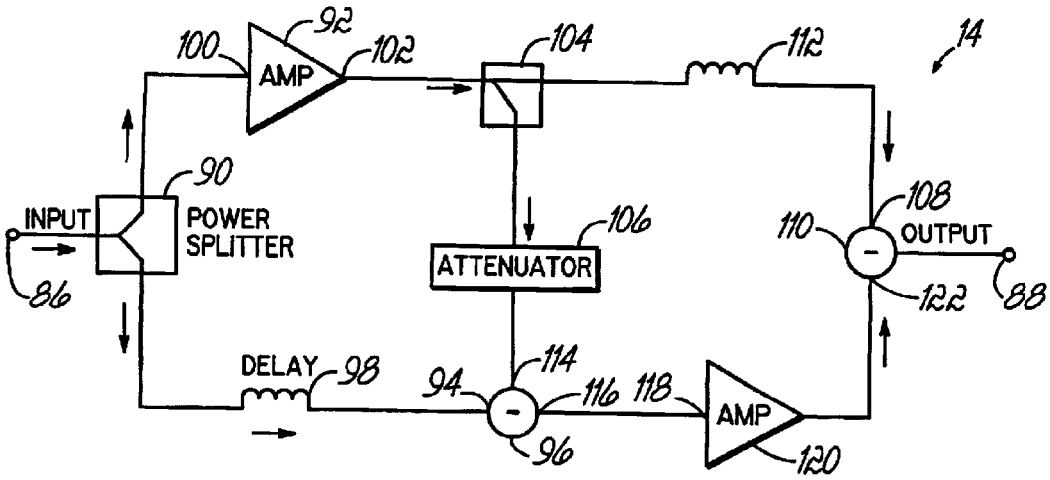
FIG. 9 is a simplified schematic of one form of linear amplifier, which may be used in connection with the invention.

FIG. 9 shows an example of a linear (multi-carrier) amplifier, which may be used as the amplifier 14. The amplifier in FIG. 9 is a feed forward design; however, other forms of linear (multi-carrier) amplifiers may be used without departing from the invention.

In one embodiment of the present invention, each of the amplifiers 14 has an input 86 operatively coupled to an RF transmitter/receiver (not shown) and an output 88 operatively coupled to the feed of each antenna element 12. The multi-carrier linear power amplifier 14 is designed to reduce or eliminate the distortion created by amplification of the feed signal in the feed forward amplifier 14.

To this end, the amplifier 14 has a power splitter 90 that directs the feed signal transmitted by the RF transmitter/receiver (not shown) to a main amplifier 92 and to an input 94 of a carrier cancellation node 96 through a delay 98. The main amplifier 92 receives the feed signal at an input 100 and generates a signal at its output 102 that comprises the feed signal amplified by a predetermined gain and distortion caused by amplification of the feed signal. The output signal generated by the main amplifier 92 is applied to a coupler 104 that directs the output signal of the main amplifier 92 to an attenuator 106 and to an input 108 of a distortion cancellation node 110 through a delay 112.

The attenuator 106 attenuates the output signal generated by the main amplifier 92 and applies the attenuated signal to a second input 114 of the carrier cancellation node 96. The carrier cancellation node 96 utilizes the signals received at inputs 94 and 114 to remove the carrier signal from the attenuated signal applied by the attenuator 106 and generate a distortion signal at its output 116 that is applied to input 118 of an error amplifier 120.

The error amplifier 120 amplifies the distortion signal generated by the carrier cancellation node 96 and applies the amplified distortion signal to a second input 122 of the distortion cancellation node 110. The distortion cancellation node 110 utilizes the signals received at inputs 108 and 122 to remove the distortion in the amplified feed signal applied by the main amplifier 92 and generate an essentially distortion-free amplified feed signal at its output 88 that is applied to the feed of an antenna element 12.

What has been shown and described herein is a novel antenna array employing power amplifiers or modules at or near the feeds of individual array antenna elements, and a number of novel installations utilizing such an antenna system.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicants' general inventive concept.

What is claimed is:

1. A distributed antenna array comprising:

a plurality of antenna elements configured in an antenna array with each of the antenna elements in the array being simultaneously coupled to a common feed signal; and a plurality of power amplifiers, each power amplifier being operatively coupled with one of said antenna elements in the antenna array and mounted closely adjacent to the associated antenna element, such that no appreciable power loss occurs between the power amplifier and the associated antenna element in the antenna array;

each said power amplifier comprising a relatively low power, multi-carrier linear power amplifier.

2. The antenna array of claim 1 wherein each antenna element is a dipole.

3. The antenna array of claim 1 wherein each antenna element is a monopole.

4. The antenna element of claim 1 wherein each antenna element is a microstrip/patch antenna element.

5. The antenna array of claim 1 and further including an attenuator circuit operatively coupled in series with each linear power amplifier for adjusting array amplitude coefficients.

6. The antenna array of claim 1 and further including a power splitter and phasing network operatively coupled with all of said linear power amplifiers.

7. The antenna array of claim 5 and further including a power splitter and phasing network operatively coupled with all said linear power amplifiers.

8. The antenna array of claim 1 wherein said antenna elements and said linear power amplifiers are coupled to a parallel feed structure.

9. The antenna array of claim 1 wherein said antenna elements and said linear power amplifiers are coupled to a series feed structure.

10. The antenna array of claim 1 wherein said antenna elements and said linear power amplifiers are coupled to a feed structure.

11. The antenna array of claim 10 wherein line length in the feed structure is selected to obtain a desired array phasing.

12. An antenna system installation comprising a tower/support structure, end an antenna structure mounted on said tower/support structure, said antenna structure comprising:

a plurality of antenna elements configured in an antenna array with each of the antenna elements in the array being simultaneously coupled to a common feed signal; and a plurality of power amplifiers, each power amplifier being operatively coupled with one of said antenna elements in the antenna array and mounted closely adjacent to the associated antenna element, such that no appreciable power loss occurs between the power amplifier and the associated antenna element in the antenna array;

each said power amplifier comprising a relatively low power, multi-carrier linear power amplifier.

13. The installation of claim 12 and further including a DC bias tee mounted on said tower/support structure and operatively coupled with said antenna structure.

14. The installation of claim 13 and further including a coaxial line operatively coupled with said DC bias tee and running to a ground-based second DC bias tee adjacent a base portion of said tower/support structure, said second DC bias tee being operatively coupled to a DC supply and an RF input/output from a transmitter/receiver.

15. The installation of claim 12 and further including a first RF transceiver and a power supply mounted at the top of said tower/support structure and operatively coupled with said antenna structure.

16. The installation of claim 15 and further including a second RF transceiver structure mounted adjacent a base portion of said tower/support structure and coupled with said first RF transceiver by a coaxial cable.

17. The installation of claim 15 and further including a second RF transceiver and a wireless link for carrying communications between said the first RF transceiver and said second RF transceiver.

18. An in-building antenna system installation comprising an antenna structure including:

a plurality of antenna elements configured in an antenna array with each of the antenna elements in the array being simultaneously coupled to a common feed signal; and a plurality of power amplifiers, each power amplifier being operatively coupled with one of said antenna elements in the antenna array and mounted closely adjacent to the associated antenna element, such that no appreciable power loss occurs between the power amplifier and the associated antenna element in the antenna array;

each said power amplifier comprising a relatively low power, multi-carrier linear power amplifier.

19. The installation of claim 18 and further including:

a DC bias tee mounted operatively coupled with said antenna structure; a coaxial line operatively coupled with said DC bias tee and running to a second DC bias tee, said second DC bias tee being operatively coupled to a DC supply and an RF input/output from a transmitter/receiver.

20. The in-building antenna system installation of claim 18 and further including:

a fiber-RF transceiver operatively coupled with said antenna structure;

a second fiber-RF transceiver, and a fiber-optic coupling the two fiber-RF transceivers.

21. The installation of claim 19 and further including a power supply coupled to said antenna structure.

* * * * *

UNITED STATES PATENT AND TRADEMARK OFFICE

CERTIFICATE OF CORRECTION

PATENT NO. : 6,812,905 B2
DATED : November 2, 2004
INVENTOR(S) : Thomas et al.

It is certified that error appears in the above-identified patent and that said Letters Patent is hereby corrected as shown below:

Column 1,
Line 52, reads "...around ten wafts." and should read -- ...around ten watts. --.

Column 6,
Line 28, reads "...support structure, end an antenna…" and should read -- …support structure, and an antenna… --.
Line 62, reads "...between said the first RF transceiver and…" and should read -- ...between the said first RF transceiver… --.

Signed and Sealed this

Nineteenth Day of April, 2005

JON W. DUDAS
*Director of the United States Patent and Trademark Office*